US007740571B1

(12) United States Patent
Le et al.

(10) Patent No.: US 7,740,571 B1
(45) Date of Patent: Jun. 22, 2010

(54) EXERCISE APPARATUS

(76) Inventors: Tiffany Thuy Vi Le, 4511 Corte Azul, Oceanside, CA (US) 92056; Brandon Huu Tho Le, 4511 Corte Azul, Oceanside, CA (US) 92056; Brittany Ai Thi Le, 4511 Corte Azul, Oceanside, CA (US) 92056; Thong Huu Le, 4511 Corte Azul, Oceanside, CA (US) 92056

( * ) Notice: Subject to any disclaimer, the term of this patent is extended or adjusted under 35 U.S.C. 154(b) by 0 days.

(21) Appl. No.: 12/316,464

(22) Filed: Dec. 13, 2008

(51) Int. Cl.
*A63B 21/02* (2006.01)

(52) U.S. Cl. ..... 482/122

(58) Field of Classification Search ..... 482/14–19, 482/23, 51, 148, 139, 142, 126; 601/31
See application file for complete search history.

(56) References Cited

U.S. PATENT DOCUMENTS 1,211,765 A * 1/1917 Schmidt ..... 482/54
2,048,587 A * 7/1936 Averill ..... 482/142
2,135,082 A * 11/1938 Kelly ..... 472/13
3,379,437 A * 4/1968 Warner ..... 472/127
3,476,404 A * 11/1969 Rachman ..... 280/30
3,887,179 A * 6/1975 Klepper et al. ..... 472/127
4,006,815 A * 2/1977 Werntz ..... 198/781.04
4,125,326 A * 11/1978 Baert ..... 355/74
4,281,830 A * 8/1981 Rehbein ..... 472/127
4,342,452 A * 8/1982 Summa ..... 482/54
4,865,313 A * 9/1989 Kuo ..... 482/54
D325,060 S * 3/1992 Matsch ..... D21/818
5,242,342 A * 9/1993 Silverman ..... 482/54
6,478,721 B1 * 11/2002 Hunter ..... 482/140
6,811,539 B1 * 11/2004 Nguyen ..... 601/31
7,344,484 B1 * 3/2008 Porcellato ..... 482/123

* cited by examiner

*Primary Examiner*—Lori Baker

(57) ABSTRACT

Exercise apparatus includes rotatable horizontal cylinder supporting user in a wide variety of exercises. Transversely spaced elongated handles extend from behind and lower than the cylinder upward and forward to substantially higher than the cylinder. The frame, cylinder, and elongated handles arranged so that user's body is supported primarily by the cylinder while user's hands can grasp the elongated handles sequentially higher and lower positions and can selectively pull and push translating user's body fore and aft on the cylinder. In exemplary embodiment, handles are bowed with upper portions positioned substantially above said cylinder to enable user sitting on said cylinder to reach upward and grasp handle upper portions, and frame includes transversely spaced posts, handles include portions extending downward to engage posts. Other features include lower handle set, vertically adjustable cylinder and soft surface cylinder and handles.

19 Claims, 5 Drawing Sheets

EXERCISE APPARATUS

BACKGROUND

The present invention related to exercise apparatus and more particularly to a new apparatus having a horizontally oriented rotatable cylinder and elongated side handles to enable the user to exercise on and across the cylinder in a variety of new exercise positions, extensions, orientations, and methods.

Children have flexible back muscle that allow them to arch with their chest upward with ease. As adults, without Exercising gravity pulls the backbones downward which causes compression and stiffness in these areas. Most back pain is due to pressure on a disc and/or irritation of the ligaments and muscles around disc. Pressure on a disc can result in pressure on a nerve or nerves of the spine which can also cause back pain. Due to ago, injury, or unhealthy occupation or lifestyle, it is necessary to build and exercise equipment to stretch and strengthen the back muscles, stretch the ligaments, and strengthen the intervertebral disk and nerves.

Placing the lumbar spine in a passively extended position allows the strained structures to come closer together, and in response, become stronger and thicker. To accomplish this, the spine should be stretched: forwardly, backwardly, and sidewardly, to increase flexibility and to strengthen and condition ligaments and other connective tissues which hold the vertebrae together. Strengthening and stretching the back muscles provides stability around the muscle and ligaments to better hold the vertebrae in place.

Various machine have been designed to address the abovementioned back problems, see for example U.S. Pat. Nos. 1,643,039; 6,478,721; 6,245,000; 5,634,887; 5,242,342; 6,375,601; 2,048,587 and 195,247 (1877).

Many attempts have been made to address the attractive appearance and health issue of flattening the abdomen or stomach by stretching and strengthening the abdomen. There has always been a desire to focus on a economic and fast way to lose fat around a person's mid-section. For example, abdominal exercise device of U.S. Pat. No. 1,936,022 has a mounted motor inside a casing allows for vibration of a ball on the abdominal area. It does not fully work the abs and the device can be uncomfortable and tedious, with little of no effective results in abdominal muscle strengthening.

SUMMARY OF EXEMPLARY EMBODIMENT OF PRESENT INVENTION

The apparatus according to the principle of the present invention includes a cylinder mounted for horizontal axial rotation on a frame and a pair of elongated side handles extending from behind and below the cylinder upward and forward to substantially above the cylinder. This fundamental arrangement enables the user to address the cylinder either by facing the cylinder or facing away from the cylinder either by facing the cylinder or facing away from the cylinder, grasping both side handles from the undersides and pulling and/or pushing the user's body back and/or torso across the cylinder to rotate the same. In this way, user not only strengthens one's arms and upper body, but the normal weight of ones upper and lower body parts are efficiently used to stretch the parts directly supported by the cylinder. In addition, user can continue this action or remain stationary on the cylinder while walking user's hands from the upper side handle portions down to the lower side handle portions to extend and stretch the back and/or abdomen muscles in a new and controlled manner. As user's hands grasp incrementally lower party of the handrails, the body is flexed and stretched incrementally more. To withdraw user need only walk users hand upward on the side rails to rise to a position enabling user to dismount the apparatus.

Additional features of the exemplary embodiment include vertical adjustment of the cylinder height to accommodate various user heights (including children). For and aft extending bottom handles for hand and/or foot gripping or standing. These bottom handles preferably extend fore and aft of the vertical frame members supporting the cylinder axle.

Advantageously, the exemplary embodiment according to the principles of the present invention provides a number of new exercise options to user, some of which shall be described below.

A principal object of the present invention is to provide an apparatus that more effectively exercises the user's spinal system, abdominal system, and other muscular and circulatory systems than prior know apparatus.

DESCRIPTION OF DRAWINGS

Other and further objects and benefits of the present invention shall become apparent with the following detailed description of an exemplary embodiment when taken in view of the appended drawings, in which.

SUMMARY OF INVENTION

Figure 1:
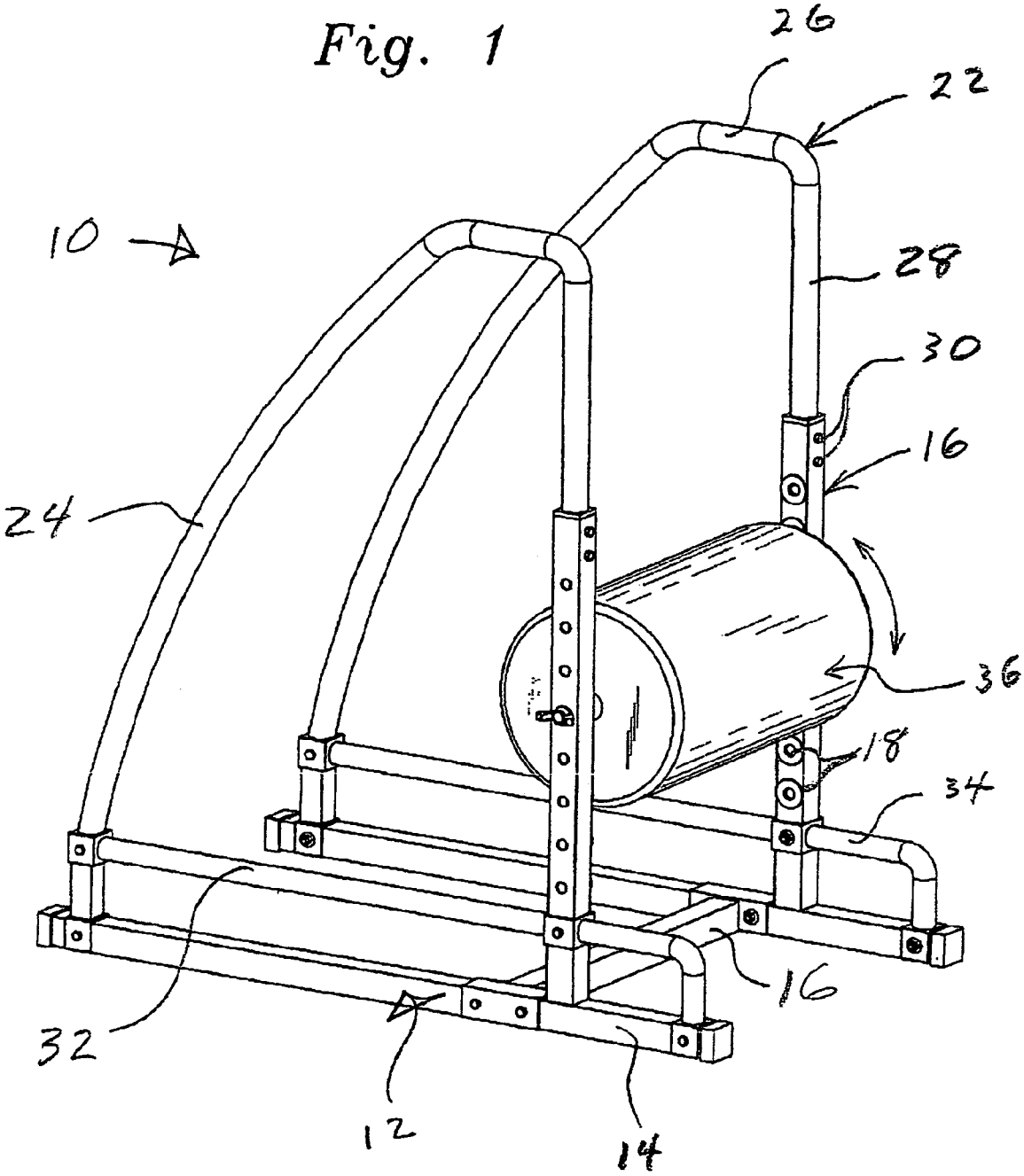
FIG. 1 is a perspective view of one exemplary embodiment according to the present invention.
Figure 2:
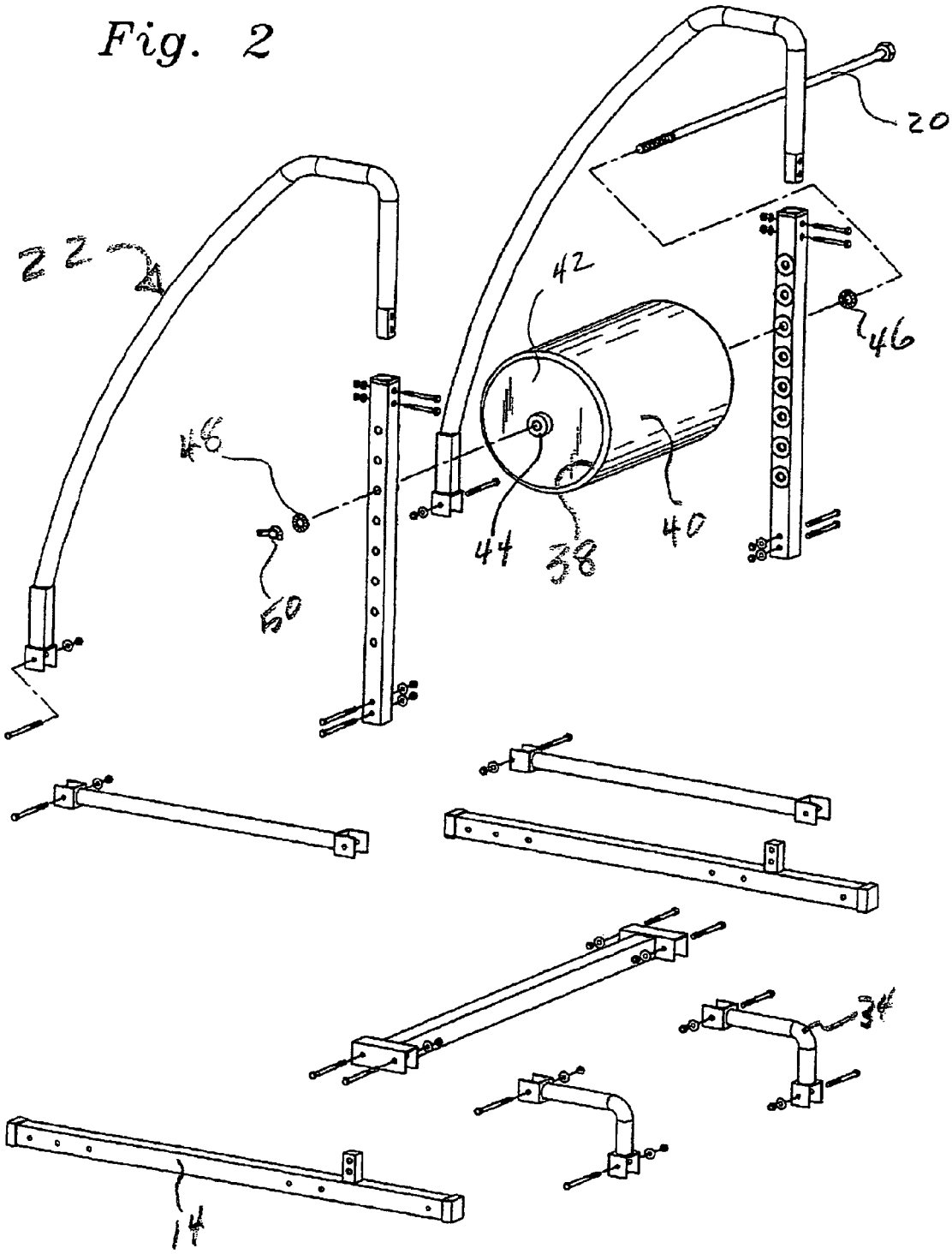
FIG. 2 is an exploded view of the elements of the FIG. 1 embodiment.
Figure 4:
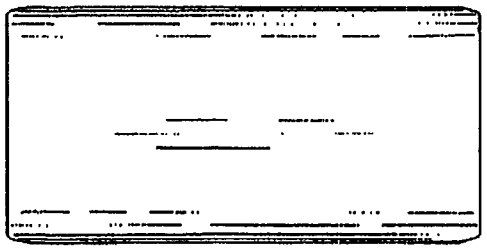
FIG. 4 is a front elevation of the coated cylinder of FIG. 3.
Figure 5:
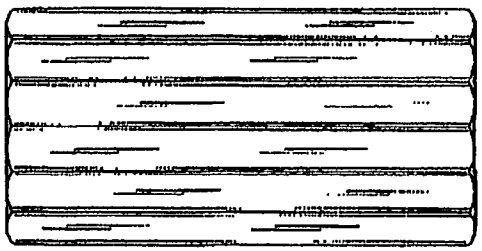
FIG. 5 is similar to FIG. 4 showing an alternate coating design.

With reference to FIGS. 1-6, one exemplary exercise apparatus 10 according to the principle of the present invention includes a bottom free assembly 12 having a pair of bottom side rails 14 rigidly connected in spaced, preferably parallel, arrangement by cross strut 16. Although only one strut 16 is shown, two fore and aft spaced struts can be employed as desired.

Apparatus 10 further includes upstanding post assemblies 16 secured on the forward portions of rails 14. Each post assembly 16 includes a vertical series of horizontally aligned through-holes 18 for receiving and mounting cylinder axel 20, better seen in FIG. 2.

Apparatus 10 further includes a pair of arcuate or angled handrail assemblies 22, which preferably include a rear arcuate handgrip sections 24 with its rear end mounted to the rear portion of rail 14 and upper end joined to hand grip section 24, which are preferably horizontally oriented. Sections 26 are joined to upstanding sections 28 which, in turn, are supported by post assemblies 16. Frame assemblies 12, post assemblies 16 and hand rail assemblies 22 should be made of metal or other suitable material that can support maximum user weight plus a suitable safety factor. Shapes and cross section shapes of these assemblies can be any suitable design such as box cylinder, tubular, triangular, or other. In this example handrails 22 are tubular with their forward, lower ends 28 inserted within the square tubes of posts 16 and secured therein by conventional fasteners 30. Although hand rails 22 can be bare metal or heavy plastic, it is preferred that sections 24, 26, 30 be covered or coated with softer foam or other material for providing more hand comfort to users during operation.

Apparatus 10 further includes a pair of lower handrails 32 mounted between lower parts of handrail section 24 and posts 16. Lower handrails 32 should be foam covered and also serve to help stabilize handrails 22 and posts 16. Lower forward rails 34 have aft ends mounted to posts 16 and forward ends vertically oriented to be mounted on the forward parts of frame rails 14. Lower rails 32 and rails 34 are preferably aligned fore and aft to further stabilize pasts 16 and provide hand and foot grips further described below.

Apparatus 10 further includes a cylinder or roller-assembly 36 having an outer preferably cylindrical surfaces 38 covered by a one or more layers 40 of foam rubber or other suitable material for providing a cushion to the user during operation. Cylinder 36 should be made of suitable material such as metal and have closed ends 43 having a central opening and bushing 44 to accommodate threaded axel 20. Axel 20 inserts through lock washer 46, and post 16, disks 42, bushings 44, the other post 16, lock washer 48 and threads into wind nut 50. Accordingly, cylinder 36 can be selectively assembled for rotation at any desired vertical position determined by the selected opening 18 through which axel 20 passes.

It will be appreciated by those of ordinary skill in the art that further positions and static and dynamic exercises can be implemented on apparatus 10 and that the above mentioned exercise methods are examples and not the methods possible.

Figure 6:
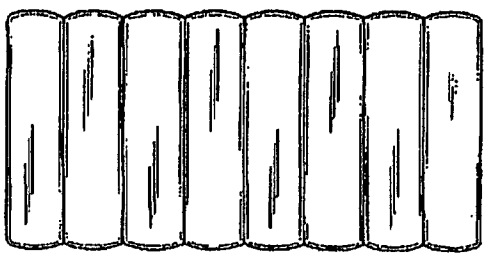
FIG. 6 is similar to FIG. 4 showing a further alternate coating design.
Figure 3:
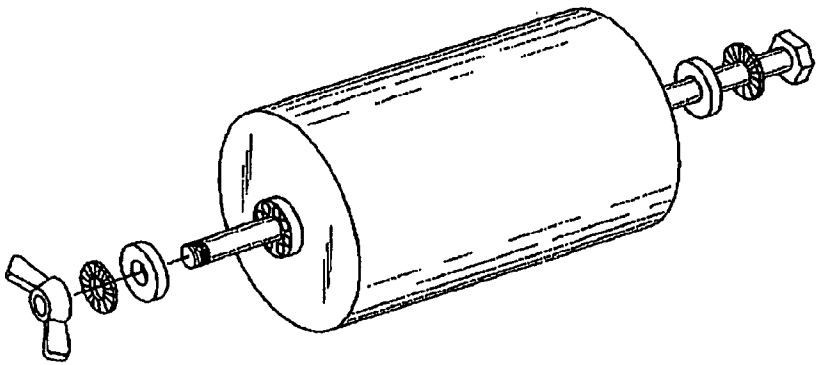
FIG. 3 is an exploded perspective view of the cylinder of FIG. 3.

Although the soft cylinder cover 40 is shown as having a substantially cylindrical surface, if desired, cover 40 could have a horizontal ribbed surface (FIG. 5) or a circumferentially ribbed surface (FIG. 6). Other designs are possible as desired.

Figure 8:
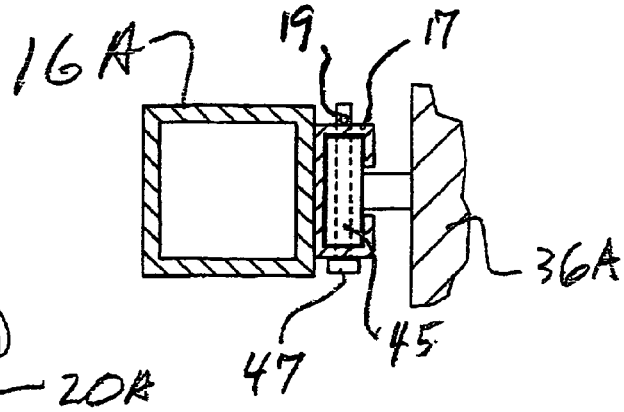
FIG. 8 is a partial horizontal top view section of the cylinder assembly and vertical post.
Figure 7:
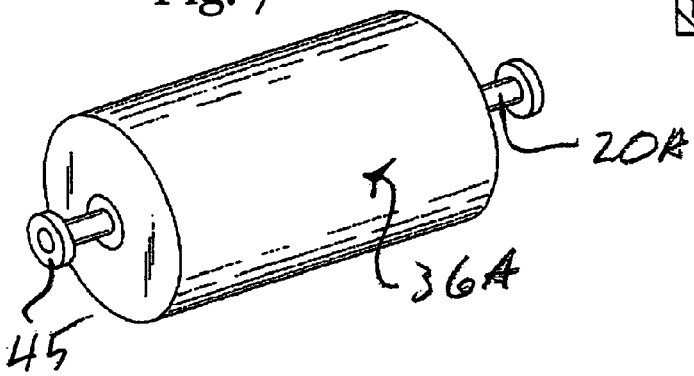
FIG. 7 is similar to FIG. 3 of an alternate cylinder assembly.
Figure 9:
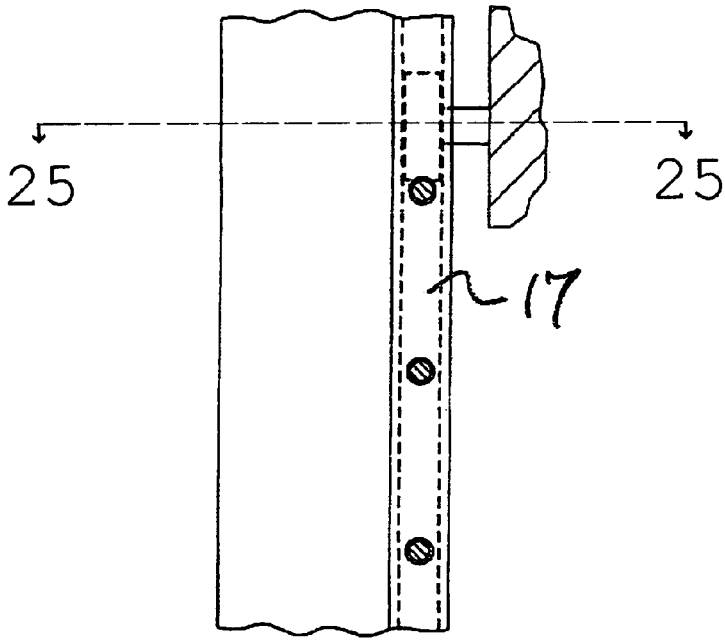
FIG. 9 is a partial side elevation view of FIG. 8.
Figure 10:
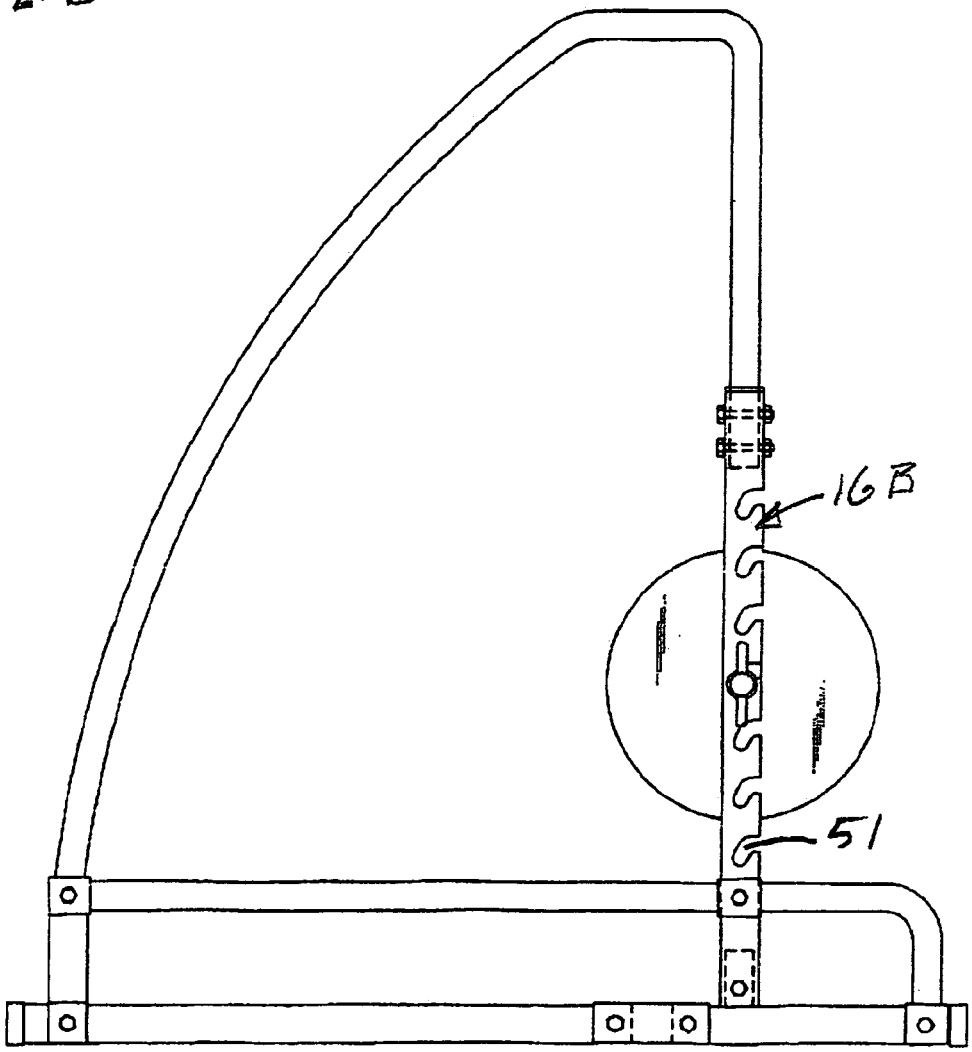
FIG. 10 is a side elevation of the frame and handrail assembly of alternate embodiment of the invention.

An alternate arrangement for cylinder and post support can be seen in FIGS. 8-10 in which cylinder assembly 36A includes a central axel 20A having a bushing or bearing assembly 45 mounted on each end of axel 20A. Each port 16A includes a support channel 17 facing cylinder 36A. A series of vertically spaced support rods 47 are seated through respective and aligned holes in the fore and aft channel parts. Rods 47 are releasably held in channel 17 by spring biased snap buttons 19. To install cylinder 36A, a predetermined rod 47 is inserted though each respective holes in each channel 17. Each brushing or bearing assembly 45 is inserted into the open top of each channel 17 and assembly 36A is lowered until the bearings 45 rests on rods 47. Then, a second pair of rods 47 is installed though the openings just above the bearings 45 to complete the installation.

To adjust the vertical position of cylinder 36A, rods 47 above bearings 45 are removed to allow upward adjustment or below bearings 45 to allow downward adjustment of cylinder 36A. The removed rods 47 (or other spare rods 47) can be installed below or above the new (desired) position and cylinder 36A moved to that position and held manually while the remaining rods 47 are installed to secure the vertical position as described above.

Figure 11:
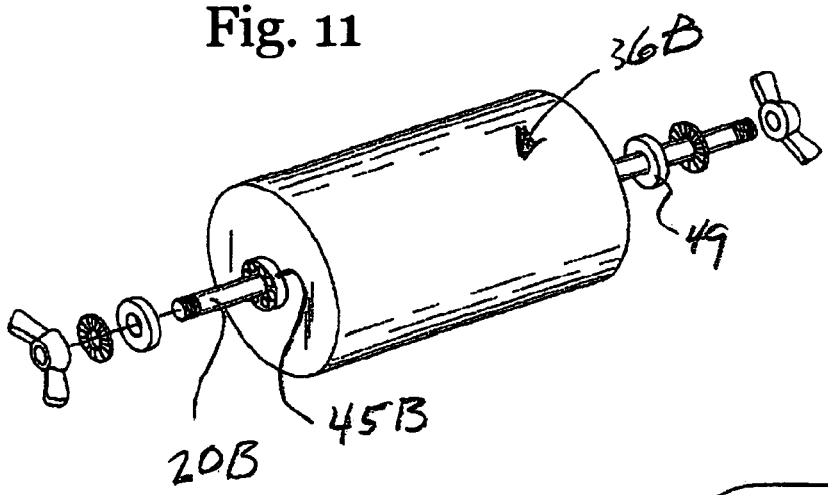
FIG. 11 is similar to FIG. 7 showing a further alternate cylinder assembly embodiment that cooperates with the frame and handrail of FIG. 10.

Yet a further exemplary arrangement is shown in FIGS. 10, 11 in which cylinder assembly 36B includes central axel 20B which is preferably threaded at both ends to cooperate with respective wing nuts. Bearing assemblies 45B are bounded by spacers or washers 49. Posts 16B include a vertical series of forward opening slots 51 that extend rearward and downward generally as shown. Alternately, slots 51 could open to the rear and could have other shapes, such as simply horizontal. Also, cylinder assembly 36B could have an axel with but a single threaded axel at one end with an enlargement at the other end, if desired.

To install, initially washers 49 are slide onto axel 20B to contact bearings 45B. Assembly 36B is then inserted into the selected vertical position by sliding axel 2B through respective horizontally aligned slots 51 and seated therein. Next lock washers can be installed outside posts 16B and then wing nuts threaded on both ends tightened against lock washers and posts 16B to secure the position. Note the full weight of the cylinder and user is carried by posts 16B. Wing nuts serve to clamp the assembly to prevent axel 20B from moving toward the slot 51 opening.

To change cylinder 36B vertical position on apparatus 10, wing nuts are loosened but not removed from axel 20B threaded ends. This removes the clamping actions mentioned above. Axel 20B can now be lifted and moved free from slot 51 through the openings thereof. User simply moves cylinder 36B to the new vertical position, inserts and seats axel 20B into the respective new slots 51, and tighten wing nuts to complete the adjustment.

Other functions changes and improvements can be made to the exemplary embodiments disclosed herein without departing from the spirit and scope of the present invention.

The invention claimed is:

1. An exercise apparatus comprising:

A frame having a base for resting on a horizontal floor surface and has a pair of transversely spaced upstanding post members, A cylinder for supporting at least substantially all of a user's weight, said cylinder, is releasably mounted to said post members at a plurality of predetermined vertical positions relative to said frame;

A pair of transversely spaced elongated handles coupled to said frame for enabling a user to grasp the same with user's hands while user's body is supported by said cylinder and extending from behind and lower than said cylinder upward and forward to substantially higher than said cylinder, Said flame, cylinder, and transversely spaced elongated handles so arranged that when a user's body is supported primarily by said cylinder, the user's hands can grasp the elongated handles in directions from said cylinder at selectively and sequentially higher and lower positions on the elongated handles and can selectively pull and push the elongated handles to translate the user's body fore and aft while the body is being primarily supported by the cylinder.

2. An exercise apparatus according to claim 1, wherein the upper forward portions of said transversely spaced elongated handles are positioned higher than said cylinder to enable a user when sitting on said cylinder with legs extending forward of said cylinder to reach generally upward to grasp said elongated handle upper portions with user's hands.

3. An exercise apparatus according to claim 1, wherein said transversely spaced elongated handles extend rearward and downward form positions substantially above and substantially vertically aligned adjacent opposite ends of the cylinder which is releasably mounted to said post members at a plurality of predetermined vertical positions relative to said frame.

4. An exercise apparatus according to claim 3, wherein said transversely spaced elongated handles are arranged generally in upstanding planes to said frame and to the pair of transversely spaced post members.

5. An exercise apparatus according to claim 3, wherein said transversely spaced elongated handles include generally bow-shaped portions.

6. An exercise apparatus according to claim 3, wherein said frame includes a pair of transversely spaced upstanding post members, and said transversely spaced elongated handles include forward portions extending downward to engage and be supported by respective ones of said post members.

7. An exercise apparatus according to claim 6, wherein said cylinder is releasably mounted to said post members.

8. An exercise apparatus according to claim 7, wherein each of said post members includes a plurality of mounts for selectively supporting said cylinder at a plurality of predetermined vertical positions relative to said frame.

9. An exercise apparatus according to claim 8, wherein at least one releasable securing member is provided to secure said cylinder at vertical position selected by the user in association with the respective mount on said post member.

10. An exercise apparatus according to claim 8, wherein said cylinder includes an axel located on said axis and having axel ends, said axel ends extend beyond the ends of said cylinder and cooperate with said mounts.

11. An exercise apparatus according to claim 9, wherein each mount comprises an opening in said post member, and the ends of said axel extend in respective ones of the openings.

12. An exercise apparatus according to claim 9, wherein each mount comprises a slot in said post members, said slot having a mouth facing toward the fore or aft direction, and the ends of said axel being seated though said mouth and into respective ones of said slots.

13. An exercise apparatus according to claim 12, wherein each slot slopes downward in the direction away from the slot mouth.

14. An exercise apparatus according to claim 10, wherein at least one end of said axel is a threaded end, and wherein at least one releasable securing member is provided to secure said cylinder at a vertical position selected by the user in association with the respective mount on said post member, said securing member comprising a fastening member threaded to said threaded end of the axel to releasably secure said axel to said post member.

15. An exercise apparatus according to claim 3, wherein the forward portions of said transversely spaced elongated handles include fore and aft extending generally horizontal portions to enable user to grasp said horizontal portions from above and in a direction toward the cylinder which is releasably mounted to said post members at a plurality of predetermined vertical positions relative to said frame.

16. An exercise apparatus according to claim 3, wherein the forward portions of said transversely spaced elongated handles include fore and aft extending generally horizontal portions to enable user to grasp said horizontal portions from above and in a direction toward the cylinder, which is releasably mounted to said post members, said fore and aft generally horizontal portions being supported by said frame.

17. An exercise apparatus according to claim 3, wherein fore and aft extending generally horizontal handles are provided to enable user to grasp said horizontal handles from above and in a direction toward the cylinder, which is releasably mounted to said post members, said fore and aft generally horizontal portions being supported by said frame and positioned to enable user to balance while standing, walking, or running on the cylinder.

18. An exercise apparatus according to claim 1, wherein a pair of transversely spaced lower handles are coupled to said frame for enabling a user to grasp the same with user's hands while user's body is supported by said cylinder, said lower handles extending rearward toward the lower portions of respective ones of said elongated handles, wherein the user can grasp said lower handles with user's hands while user's body is supported by the cylinder.

19. An exercise apparatus according to claim 18, wherein user can grasp progressively rearward portions of the lower handles to translate user's body aft while the body engages and rotates said cylinder until user's torso or legs are supported by the cylinder and user's upper body is primarily supported by user's arms, hands, and said lower handles.

* * * * *